US006954150B2

(12) United States Patent
Nishimura et al.

(10) Patent No.: US 6,954,150 B2
(45) Date of Patent: Oct. 11, 2005

(54) HYDRAULIC SHOVEL CONCURRENTLY USED FOR CRANE OPERATIONS

(75) Inventors: Satoru Nishimura, Hirakata (JP); Takumi Nagahara, Hirakata (JP); Masamichi Ueda, Hiratsuka (JP); Mitsuhiro Shimazu, Hiratsuka (JP)

(73) Assignee: Komatsu, Ltd., Tokyo (JP)

( * ) Notice: Subject to any disclaimer, the term of this patent is extended or adjusted under 35 U.S.C. 154(b) by 203 days.

(21) Appl. No.: 10/183,954

(22) Filed: Jun. 28, 2002

(65) Prior Publication Data

US 2003/0090384 A1 May 15, 2003

(30) Foreign Application Priority Data

Jun. 28, 2001 (JP) ..... 2001-196205
Jun. 28, 2001 (JP) ..... 2001-196206

(51) Int. Cl.[7] ..... G08B 21/00
(52) U.S. Cl. ..... 340/685; 340/665; 340/684; 340/868.1; 340/691.1; 340/691.4; 340/691.6
(58) Field of Search ..... 340/685, 665, 340/684, 686.1, 691.1, 691.4, 691.6

(56) References Cited

U.S. PATENT DOCUMENTS 4,368,824 A * 1/1983 Thomasson ..... 212/278
4,532,595 A * 7/1985 Wilhelm ..... 701/124
4,660,729 A * 4/1987 Carbert ..... 212/278
4,833,615 A * 5/1989 Bitner et al. ..... 701/124
5,081,838 A * 1/1992 Miyaoka et al. ..... 60/444
5,824,965 A * 10/1998 Fujii et al. ..... 177/136
6,334,085 B1 * 12/2001 Kawamura et al. ..... 701/115
6,492,901 B1 * 12/2002 Ridolfo ..... 340/506

* cited by examiner

*Primary Examiner*—Tai T. Nguyen
(74) *Attorney, Agent, or Firm*—Westerman, Hattori, Daniels, & Adrian, LLP

(57) ABSTRACT

It is a subject of the present invention to provide a hydraulic shovel concurrently used for crane operations in which an operator may immediately be ascertained of conditions during crane operations as well as dangerous conditions occurring on the implement or the vehicle body so that operations may be performed in a stable and rapid manner, this being achieved by a hydraulic shovel concurrently used for crane operations which comprises an implement including a boom, an arm, a bucket and a hook for enabling crane operations, which further comprises a monitor device including a monitor screen, wherein a parameter display portion for displaying parameters related to load factors of safe-working load, an engine condition display portion for displaying engine conditions and an alarm information display portion for displaying alarm information are provided on the monitor screen during crane operations, wherein a plurality of display items of the alarm information display portion may be sequentially switched and displayed, and wherein the parameter display portion is turned into an alarm color when the load factor for safe-working load is within a dangerous area.

8 Claims, 12 Drawing Sheets

(a)

(b)

(a)

(b)

(a)

(b)

HYDRAULIC SHOVEL CONCURRENTLY USED FOR CRANE OPERATIONS

BACKGROUND OF THE INVENTION

1. Field of the Invention

The present invention relates to a hydraulic shovel concurrently used for crane operations.

2. Description of the Prior Art

A hydraulic shovel concurrently used for crane operations is comprised of a lower running body and an upper turning body that is mounted onto this lower running body via a turning mechanism such that it may freely turn, wherein an implement is provided on the upper turning body. The implement includes a boom, an arm and a bucket. And the hydraulic shovels concurrently used for crane operations of this type are provided with a hook at a tip end portion of the implement for enabling crane operations. More particularly, the bucket is pivotally attached to the arm via a swinging mechanism such that, for instance, the hook is suspended from a pivot shaft comprising a part of this rocking mechanism.

A safe-working load for loads to be suspended is preliminarily set for suspending operations performed during crane operations, and it is necessary to take care that an actual load with a member to be suspended being in a suspended condition will not exceed this safe-working load. For this purpose, a load display monitor was conventionally provided for displaying the actual load or the safe-working load on this load display monitor so as to inform an operator of these loads. It is further necessary to confirm engine conditions of this hydraulic shovel concurrently used for crane operations for which purpose another monitor screen was required. More particularly, in performing ordinary excavation operations, it was sufficient to keep track of engine conditions such as cooling water temperature for the engine, engine oil temperature or the amount of fuel remaining and others to ascertain the condition of the entire vehicle whereas the load conditions need to be ascertained in addition to the above when performing crane operations to be sure to keep track of the condition of the entire vehicle body. In other words, when performing crane operations, load conditions acting on the vehicle body besides engine conditions function as factors that largely affect the entire vehicle body, and it will be a premise for performing stable operations to keep track of this load conditions as well.

However, since the load display monitor was provided at a different position than the monitor screen for watching the engine conditions so that the operator may not observe these two in a simultaneous manner that led to difficulties in operations and complications in confirming conditions when performing crane operations.

Moreover, since only the actual load or safe-working load was displayed on the above-mentioned load display monitor, the operator needed to judge by himself or herself on the basis of these numeric values whether the vehicle is in a dangerous condition or not which may have led to delays in operating speed. It has thus conventionally been developed for an overload preventing and alarming device, which was provided either in addition to the above-mentioned load display monitor or singly, for generating alarm sounds in case the suspending load (actual load) reached, for example, 90% of the safe-working load for the particularly posture. However, even though the arrangement may be that such alarm sounds are generated, it may happen that the operator may not hear them owing to noise or other factors at site so that it was impossible to inform the operator of dangerous conditions in a stable manner. In performing suspending operations during crane operations, problems are presented in that contact between hooks and buckets causes damages in the hooks and buckets or inconveniences in suspending members to be suspended by the hooks (hook contact problems) and the like in addition to the problem of overload. It was, however, conventionally the case that alarm means was employed that was capable of only informing that a dangerous area has been reached in view of the problem of this hook contact and the like.

SUMMARY OF THE INVENTION

The present invention has been made for solving the above conventional problems, and it is an object thereof to provide a hydraulic shovel concurrently used for crane operations enabling the operator to immediately keep track of conditions during crane operations and dangerous conditions occurring on the implement or the vehicle body and to perform operations in a stable and rapid manner.

For this purpose, the hydraulic shovel concurrently used for crane operations according to a first aspect of the present invention is comprised with an implement 4 including a boom 5, an arm 6, a bucket 7 and a hook 10 for enabling crane operations, the hydraulic shovel concurrently used for crane operations comprising a monitor device including a monitor screen 44, wherein it is possible to display parameters related to load factors of safe-working load (which maybe hereinafter referred to as "load factor" in abbreviated form) and alarm information on the above-mentioned monitor screen 44 in above-mentioned crane operations while it is further possible to perform sequentially switched display of a plurality of display items of an alarm information display portion 53, and wherein a parameter display portion 51 is turned into an alarm color in case the above-mentioned load factor is within a dangerous area.

In the hydraulic shovel concurrently used for crane operations according to the first aspect described above, parameters related to load factors and alarm information are displayed on the monitor screen 44 of the monitor device during crane operations so that it is possible to keep track of dangerous conditions of load factors through these parameters, and in case the implement 4 is in an alarm condition (dangerous condition), this fact may be recognized through alarm information. As for the alarm information, since display items are sequentially switched, it is possible to keep track of various alarms of danger. Moreover, since the parameter display portion 51 turns into an alarm color when the load factor is in the dangerous area, it will be easy for the operator to judge whether the load factor is in a dangerous condition or not to thereby enable effective operations.

In the hydraulic shovel concurrently used for crane operations according to a second aspect of the present invention, the above-mentioned alarm information includes arm grounding angle alarm in which an angle formed between the arm 6 of the implement 4 and a ground surface becomes a specified alarm angle and hook contact alarm in which the hook 10 and the bucket 7 of the implement 4 come into contact.

Since the alarm information of the hydraulic shovel concurrently used for crane operations according to the second aspect described above includes arm grounding angle alarm and hook contact alarm, it is possible to prevent the arm 6 from coming to a dangerous angle and to effectively prevent the hook 10 from contacting the bucket 7. With this arrangement, crane operations may be effectively performed.

In the hydraulic shovel concurrently used for crane operations according to a third aspect of the present invention, the above-mentioned parameter display portion 51 is disposed in a center of the above-mentioned monitor screen 44 whereas the alarm information display portion 53 is disposed around the parameter display portion 51 to be smaller than the parameter display portion.

Since the parameter display portion 51 is disposed in a center of the monitor screen 44 in the hydraulic shovel concurrently used for crane operations according to the third aspect described above, the operator has a good sight of the parameters displayed thereon to be capable of effectively performing crane operations.

In the hydraulic shovel concurrently used for crane operations according to a fourth aspect of the present invention, an alarm sound is generated in case the above-mentioned parameter display portion 51 and/or the alarm information display portion 53 is in the alarm color.

Since the parameter display portion 51 and/or the alarm information display portion 53 will turn into the alarm color in addition to issuing an alarm sound in case the load factor or some other parameter is in a dangerous area in the hydraulic shovel concurrently used for crane operations according to the fourth aspect described above, the operator may reliably know that the load factor is in the dangerous area with his or her eyes and ears so that it is possible to perform operations in an effective manner.

The hydraulic shovel concurrently used for crane operations according to a fifth aspect of the present invention is arranged in that the parameter display portion 51 and/or the alarm information display portion 53 is turned into an advanced notice color when in an advanced notice area that is close to the dangerous area and into the above-mentioned alarm color when in the above-mentioned dangerous area.

In the hydraulic shovel concurrently used for crane operations according to the fifth aspect described above, since the parameter display portion 51 and/or the alarm information display portion 53 is turned into an advanced notice color when in an advanced notice area that is close to the dangerous area, the operator may be ascertained that the dangerous area is close so that operations may be performed at great care. Since the color will change to the alarm color when the dangerous area has been entered, the operator may know that the dangerous area has been entered so that operations may be terminated or the implement swung into a safe direction.

The hydraulic shovel concurrently used for crane operations according to a sixth aspect of the present invention is arranged in that the parameter display portion and/or the alarm information display portion generates an advanced notice sound when in the advanced notice color and the above-mentioned alarm sound that is different from the above-mentioned advanced notice sound when in the alarm color.

In the hydraulic shovel concurrently used for crane operations according to the sixth aspect described above, since the parameter display portion and/or the alarm information display portion turned into an advanced notice color when in an advanced notice area that is close to the dangerous area and an advanced notice sound issued when in this advanced notice color, the operator may reliably know that the dangerous area is close with his or her eyes and ears so that it is possible to perform operations with great care. Moreover, since the color will change to the alarm color when the dangerous area has been entered and an alarm sound issued when in the alarm color, the operator may reliably know that the dangerous area has been entered with his or her eyes and ears so that it is possible to perform safe operations in a more reliable manner.

The hydraulic shovel concurrently used for crane operations according to a seventh aspect of the present invention is arranged in that an engine condition is displayed on the above-mentioned monitor screen 44.

Since the engine condition is displayed on the monitor screen 44 in addition to parameters related to the above-mentioned load factors during crane operations in the hydraulic shovel concurrently used for crane operations according to the seventh aspect described above, the operator of this hydraulic shovel concurrently used for crane operations may easily and rapidly know the vehicle body condition required during the operation.

The hydraulic shovel concurrently used for crane operations according to a eighth aspect of the present invention is arranged in that the parameter display portion 51 is disposed in a central portion of the monitor screen 44 whereas an engine condition display portion 52 for displaying the above-mentioned engine condition is disposed around this parameter display portion 51.

Since the parameter display portion 51 is disposed in a central portion of the monitor screen 44 in the hydraulic shovel concurrently used for crane operations according to the eighth aspect described above, parameters that are displayed on this parameter display portion 51 can be easily observed to keep easily track of this parameters.

The hydraulic shovel concurrently used for crane operations according to a ninth aspect of the present invention is arranged in that parameters that are displayed on the parameter display portion 51 are related to actual load, safe-working load, operating radius, operating height and load factor of safe-working load and others, and wherein multiple switch display among these is possible.

In the hydraulic shovel concurrently used for crane operations according to the ninth aspect described above, it is possible to display a variety of parameters to easily and rapidly keep track of various conditions during operations.

The hydraulic shovel concurrently used for crane operations according to a tenth aspect of the present invention is provided an implement 4 including a boom 5, an arm 6, a bucket 7 and a hook 10 for enabling crane operations, the hydraulic shovel concurrently used for crane operations comprising a monitor device 45 including a monitor screen 44, wherein it is possible to display parameters related to load factors of safe-working load and engine conditions on the above-mentioned monitor screen 44 during the above-mentioned crane operations.

In the hydraulic shovel concurrently used for crane operations according to the tenth aspect described above, since both of parameters related to load factors and engine conditions are simultaneously displayed on the monitor screen 44 during crane operations, the operator of this hydraulic shovel concurrently used for crane operations may easily and rapidly keep track of conditions of the vehicle body required during operation.

The hydraulic shovel concurrently used for crane operations according to a eleventh aspect of the present invention is arranged in that a parameter display portion 51 for displaying parameters related to the above-mentioned load factors is disposed in a central portion of the monitor screen 44 whereas an engine condition display portion 52 for displaying the above-mentioned engine conditions is disposed around this parameter display portion 51.

Since the parameter display portion 51 is disposed in a central portion of the monitor screen 44 in the hydraulic shovel concurrently used for crane operations according to the eleventh aspect described above, parameters that are displayed on this parameter display portion 51 may be easily observed to keep easily track of the parameters.

The hydraulic shovel concurrently used for crane operations according to a twelfth aspect of the present invention is arranged in that the parameters that are displayed on the parameter display portion 51 are related to actual load, safe-working load, operating radius, operating height and load factor of safe-working load and others, and wherein multiple switched display among these is possible.

In the hydraulic shovel concurrently used for crane operations according to the twelfth aspect described above, it is possible to display a variety of parameters to easily and rapidly keep track of various conditions during operations.

DETAILED DESCRIPTION OF THE PREFERRED EMBODIMENTS

Figure 1:
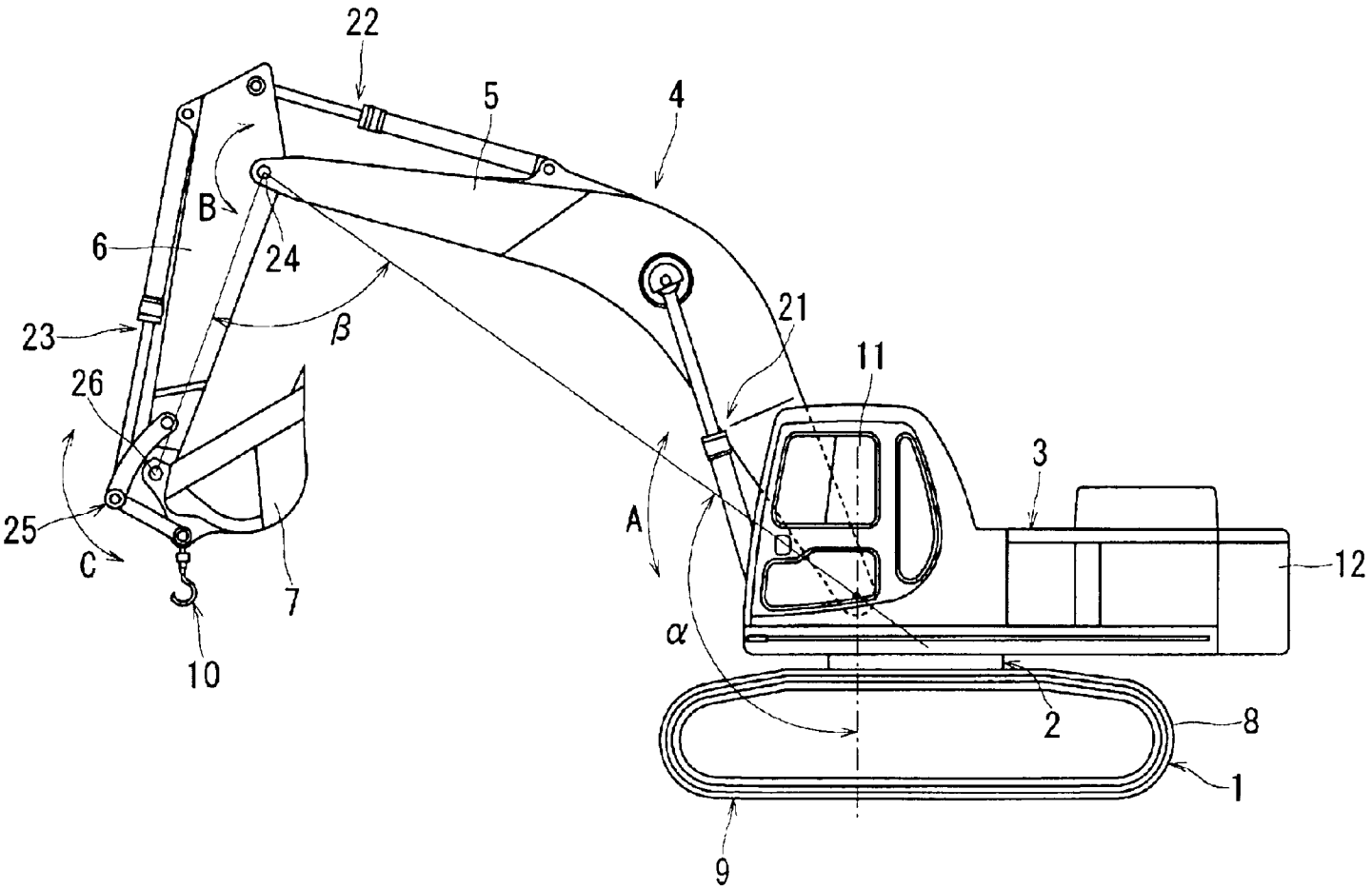
FIG. 1 is a simplified side view illustrating one form for embodying the hydraulic shovel concurrently used for crane operations according to the present invention.

Concrete embodiments of the hydraulic shovel concurrently used for crane operations of the present invention will now be explained in details while referring to the drawings. FIG. 1 is a simplified side view of the hydraulic shovel concurrently used for crane operations. The hydraulic shovel concurrently used for crane operations is included of a lower running body 1 and an upper turning body 3 that is mounted onto the lower running body 1 via a turning mechanism 2 such that it may freely turn, wherein an implement 4 is provided on the upper turning body 3. The implement 4 includes a boom 5 which base portion is coupled to the upper turning body 3 in a freely swinging manner, an arm 6 that is coupled to a tip end of the boom 5 in a freely swinging manner, and a bucket 7 that is coupled to a tip end of the arm 6 in a freely swinging manner. A hook 10 is further provided at a tip end portion of the implement 4 so that this hydraulic shovel concurrently used for crane operations is capable of performing crane operations. The lower running body 1 is comprised with a pair of right and left running portions 9, 9 with crawler belts 8 so as to perform running upon driving of the crawler belts 8, 8 of the respective running portions 9, 9. The upper turning body 3 is further comprised with a driver's cab 11 and a counterweight 12.

Figure 2:
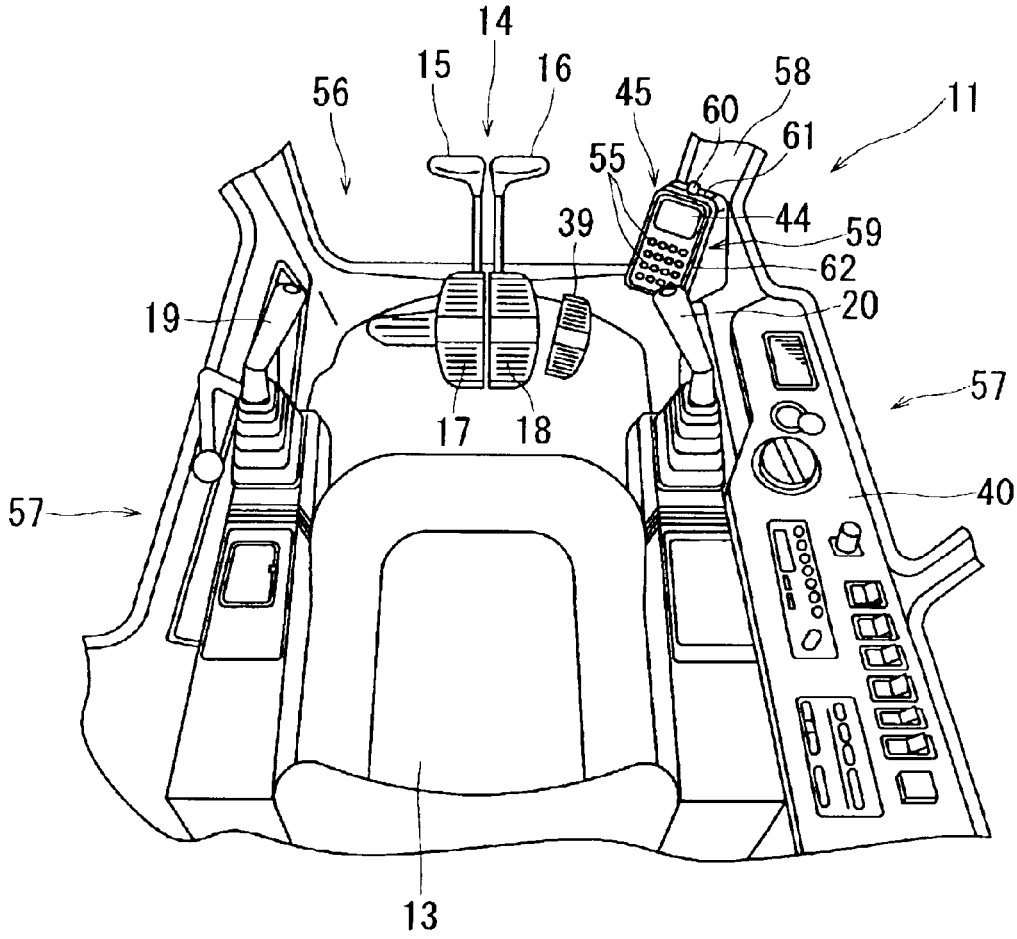
FIG. 2 is a perspective view of a driver's cab of the above hydraulic shovel concurrently used for crane operations.

As illustrated in FIG. 2, the driver's cab 11 of the upper turning body 3 is provided with a driver's seat 13 in a central portion thereof, and driving steering means 14 is provided frontward of this driver's seat 13. The driving steering means 14 is comprised with driving levers 15, 16 and driving pedals 17, 18 that are integrally swung with the respective driving levers 15, 16. In this case, the lower running body 1 moves forward upon pressing the driving levers 15, 16 frontward while the lower running body 1 moves rearward upon pulling the driving levers 15, 16 rearward. It should be noted that an attachment pedal 39 is provided proximate to the driving steering means 14 while an instrument panel 40 is provided on one lateral window 57 side.

Implement steering levers 19, 20 are respectively provided on a side portion side of the driver's seat 13. The implement steering levers 19, 20 function to perform up and down movements of the boom 5, rotation of the arm 6 and the bucket 7, as well as turning operations of the upper turning body 3 itself and the like. More particularly, the upper turning body 3 and the boom 5 are coupled through a cylinder mechanism 21, the boom 5 and the arm 6 are coupled through a cylinder mechanism 22, and the arm 6 and the bucket 7 through a cylinder mechanism 23 as illustrated in FIG. 1. Thus, by operating the above-mentioned implement steering levers 19, 20, a piston rod of the cylinder mechanism 21 is made to expand and shrink to affect swinging (rotating) movements in direction A of the boom 5 with its base portion being the center; a piston rod of the cylinder mechanism 22 is made to expand and shrink to affect swinging (rotating) movements in direction B of the arm 6 with a pivot shaft 24 of its base portion being the center, and a piston rod of the cylinder mechanism 23 is made to expand and shrink to affect swinging (rotating) movements in direction C of the bucket 7 with a pivot shaft 26 of its base portion being the center.

Figure 3:
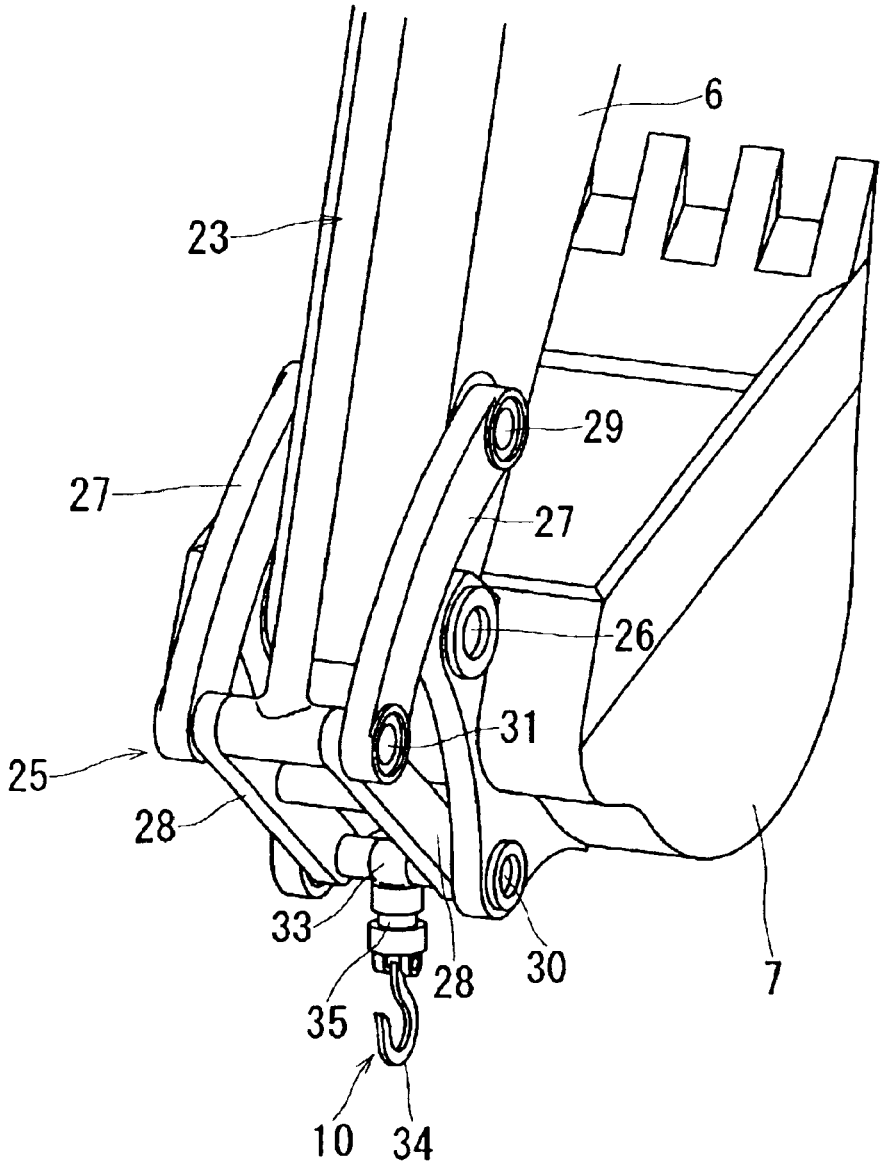
FIG. 3 is a perspective view of a tip end portion of an implement of the above hydraulic shovel concurrently used for crane operations.

A tip end portion of the piston rod of the cylinder mechanism 23 is pivotally attached to a swinging mechanism 25 and the above-mentioned hook 10 is mounted to swinging mechanism 25. In this case, the swinging mechanism 25 is included, as illustrated in FIG. 3, with first arms 27, 27 and second arms 28, 28 wherein one end portions of the first arms 27, 27 are pivotally attached to the tip end portion of the arm 6 through a shaft 29, one end portions of the second arms 28, 28 are pivotally attached to a base end portion of the bucket 7 through a shaft 30, and the other end portions of the first arms 27, 27 and the other end portions of the second arms 28, 28 are pivotally coupled through a shaft 31. Then, the tip end portion of the piston rod of the above-mentioned cylinder mechanism 23 is coupled to this shaft 31 whereas the hook 10 is suspended from the shaft 30.

The above-mentioned hook 10 is included a base portion 33 and a hook main body portion 34 that are coupled through a coupling portion 35 such that the hook main body portion 34 may be freely rotated with respect to the base portion 33. Then, a hole portion is formed at the base portion 33 and the above-mentioned shaft 30 is pierced through this hole portion, so that this hook 10 is hung down from the tip end portion of the implement 4 and members to be suspended (not shown in the drawings) may be suspended from this hook 10.

Figure 4:
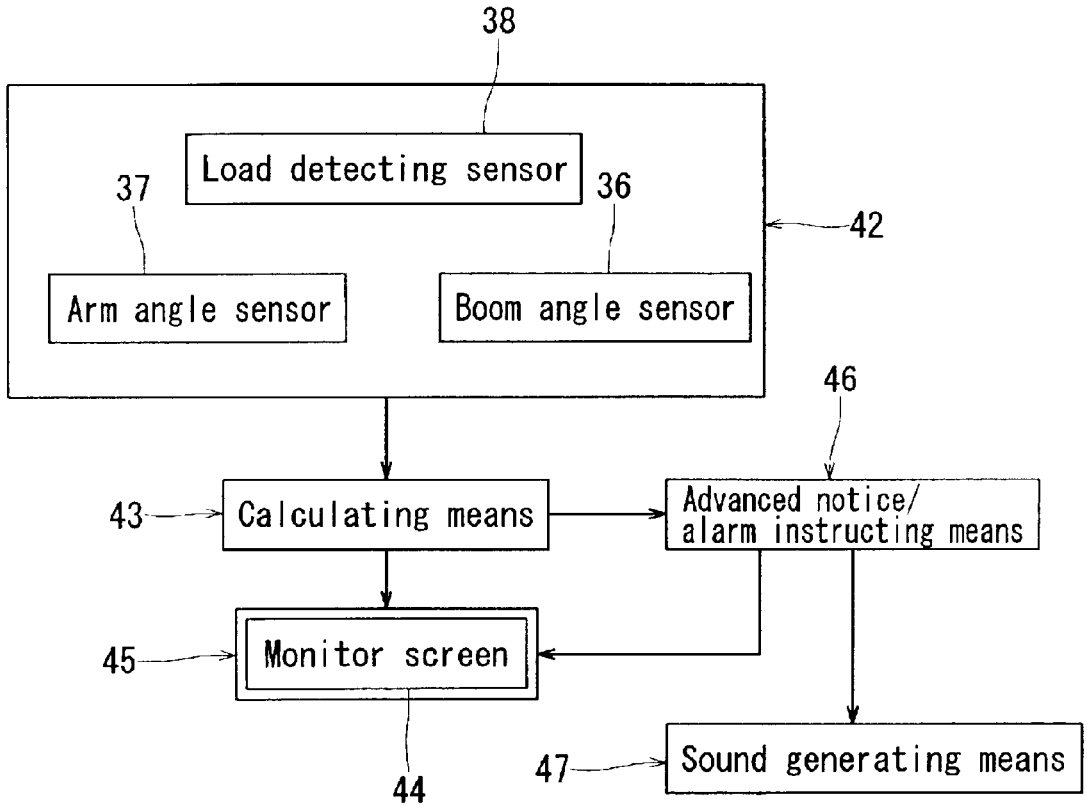
FIG. 4 is a block diagram of a control portion of the above hydraulic shovel concurrently used for crane operations.

As illustrated in FIG. 4, the hydraulic shovel concurrently used for crane operations is included, among others, detecting means 42 including a boom angle sensor 36, an arm angle sensor 37, and a load detecting sensor 38; calculating means 43 into which respective detected data are input from the detecting means 42; and a monitor device 45 with a monitor screen 44 on which calculated values as obtained in the calculating means 43 are displayed. In this case, the boom angle sensor 36 is provided on the base end portion side of the boom 5 for detecting a boom angle $\alpha$ while the arm angle sensor 37 is provided on the base end portion side of the arm 6 for detecting an arm angle $\beta$ as illustrated in FIG. 1. The load detecting sensor 38 includes a bottom pressure sensor and a head pressure sensor for the boom cylinder (cylinder mechanism 21) for detecting a suspended load of the hook 10.

Figure 7:
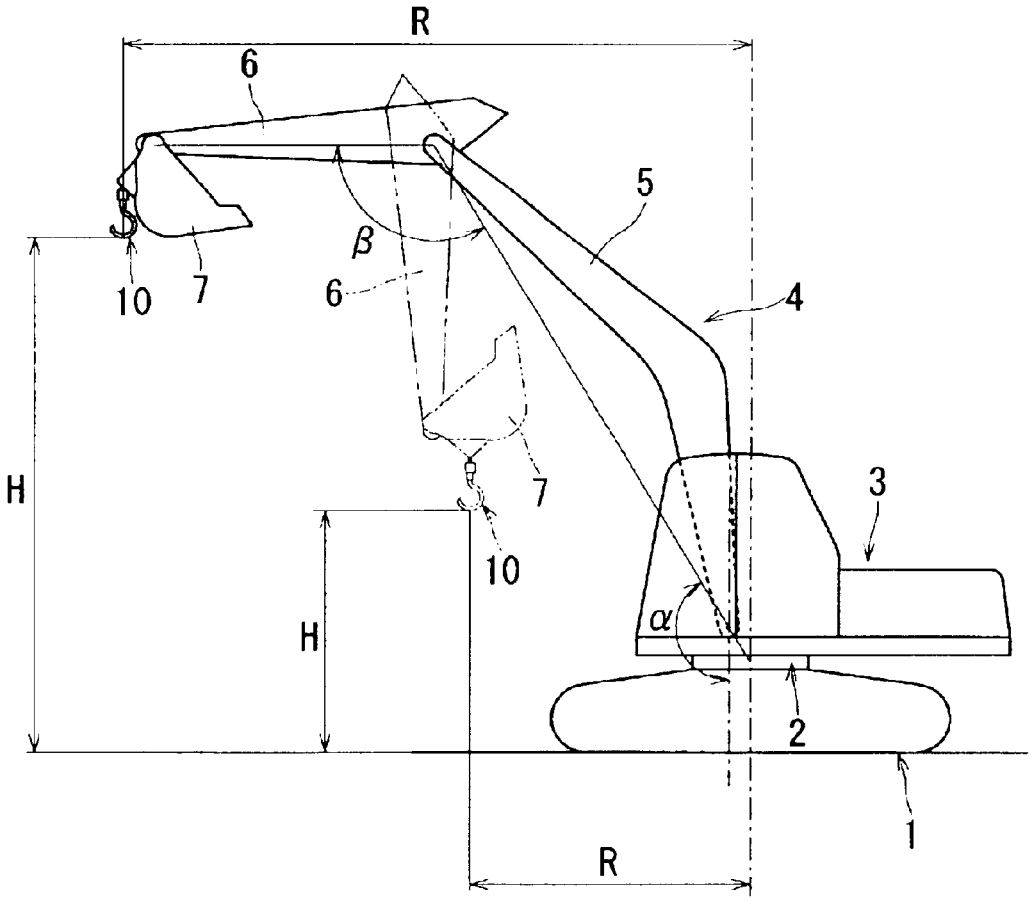
FIG. 7 is an explanatory view of an operating range of the above hydraulic shovel concurrently used for crane operations.

In case of a hydraulic shovel concurrently used for crane operations that is capable of performing crane operations, the boom angle $\alpha$ and the arm angle $\beta$ will be large as illustrated by the solid line in FIG. 7 such that a danger exists that the hook 10 contacts the bucket 7 while it may further happen, as illustrated by the virtual line in FIG. 7, that the arm 6 may be further swung to the boom 5 side from the vertically extended condition so that this should be prevented. For this purpose, the hydraulic shovel concurrently used for crane operations is arranged that hook contact alarm (alarm that the hook 10 may contact the bucket 7) and arm grounding angle alarm (alarm that the arm 6 might get out of the set operating range) is displayed on the monitor screen 44 of the above-mentioned monitor device 45 that is provided in the driver's cab 11 on the basis of the above boom angle $\alpha$ and the above arm angle $\beta$. For this purpose, this hydraulic shovel concurrently used for crane operations is provided with, among others, advanced notice/alarm instructing means 46 and sound generating means 47 as illustrated in FIG. 4. It should be noted that the above-mentioned calculating means 43 or the advanced notice/alarm instructing means 46 and the like may be consisted by a microcomputer.

Figure 8:
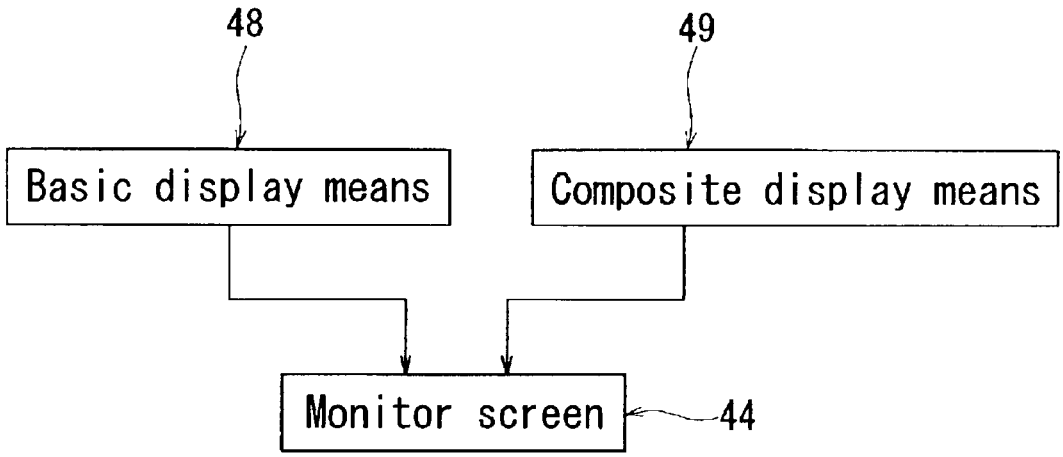
FIG. 8 is a simplified block diagram of the control portion of the above hydraulic shovel concurrently used for crane operations.

As illustrated in FIGS. 5A and 5B, the monitor screen 44 of the above monitor device 45 may be switched between a first mode for displaying engine conditions and a second mode for displaying parameters related to load factors of safe-working load. Here, engine conditions include, for instance, temperature of the engine cooling water, engine oil temperature, or amount of fuel remaining and the like. More particularly, as illustrated in FIG. 8, the control portion of the monitor device 45 is included basic display means 48 for displaying a basic image such as temperature scales or various pictures and designs and composite display means 49 for displaying a composited picture for the monitor screen 44 upon compositing the basic image data with image data indicative of amounts of conditions. With this arrangement, the engine condition may be displayed on the monitor screen 44. It should be noted that the monitor screen 44, for example, is consisted by a liquid crystal panel.

In case of the second mode, there are provided a parameter display portion 51 for displaying parameters, an engine condition display portion 52 for displaying engine conditions and an alarm information display portion 53 for displaying alarm information as illustrated in FIG. 5B. The parameter display portion 51 is disposed in a central portion of the monitor screen 44 and includes a first portion 51*a* and a second portion 51*b* that are vertically aligned. Here, parameters include actual load, safe-working load, lift (operating height) H, operating radius R, and load factor of safe-working load and the like, wherein the safe-working load is a load that may be suspended as preliminarily set for various conditions of the implement 4 and thus differs depending on the position of the implement 4. As further illustrated in FIG. 7, the lift H is a height from the ground surface up to the hook 10 while the operating radius R indicates a length between a rotation center of the upper turning body 3 to the hook 10. Further, the load factor of safe-working load is a value obtained by dividing the actual load by the safe-working load.

The engine condition of the second mode is related to the engine of the hydraulic shovel concurrently used for crane operations such as the amount of fuel remaining, the temperature of the engine cooling water or the engine oil temperature, and is provided on the right and left of the parameter display portion 51. The alarm information of the alarm information display portion 53 includes the above hook contact alarm or arm grounding angle alarm and the like, wherein the alarm information display portion 53 is disposed upward of the parameter display portion 51 to be of a size that is smaller than that of this parameter display portion 51.

Figure 5:
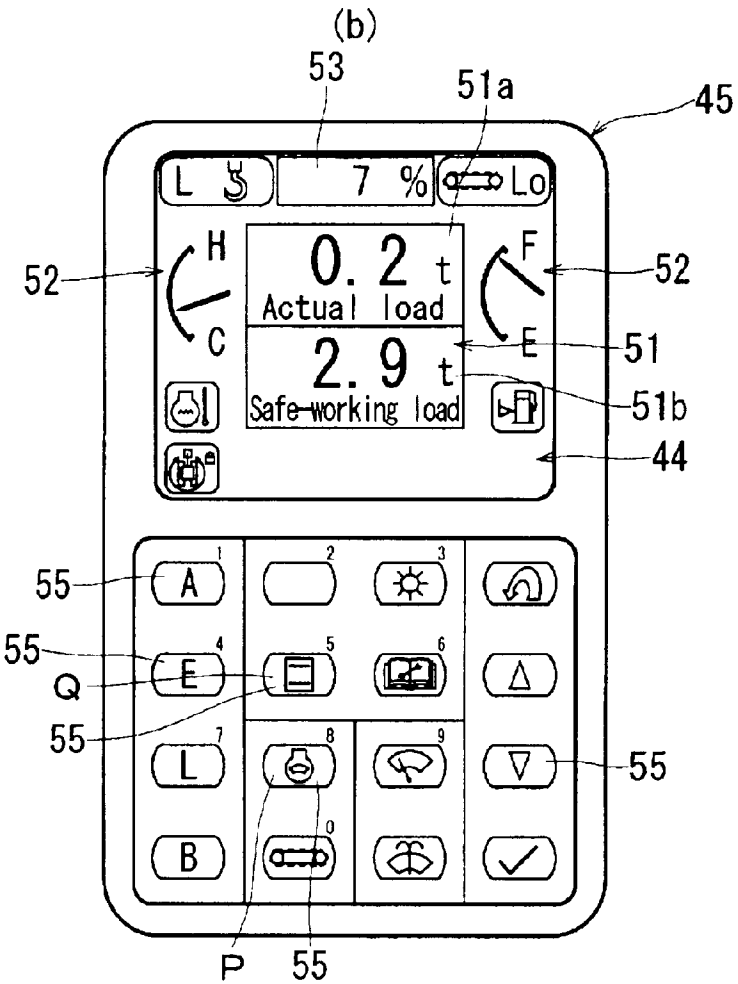
FIG. 5 is an explanatory view of a monitor screen of a monitor device of the above hydraulic shovel concurrently used for crane operations.
Figure 5:
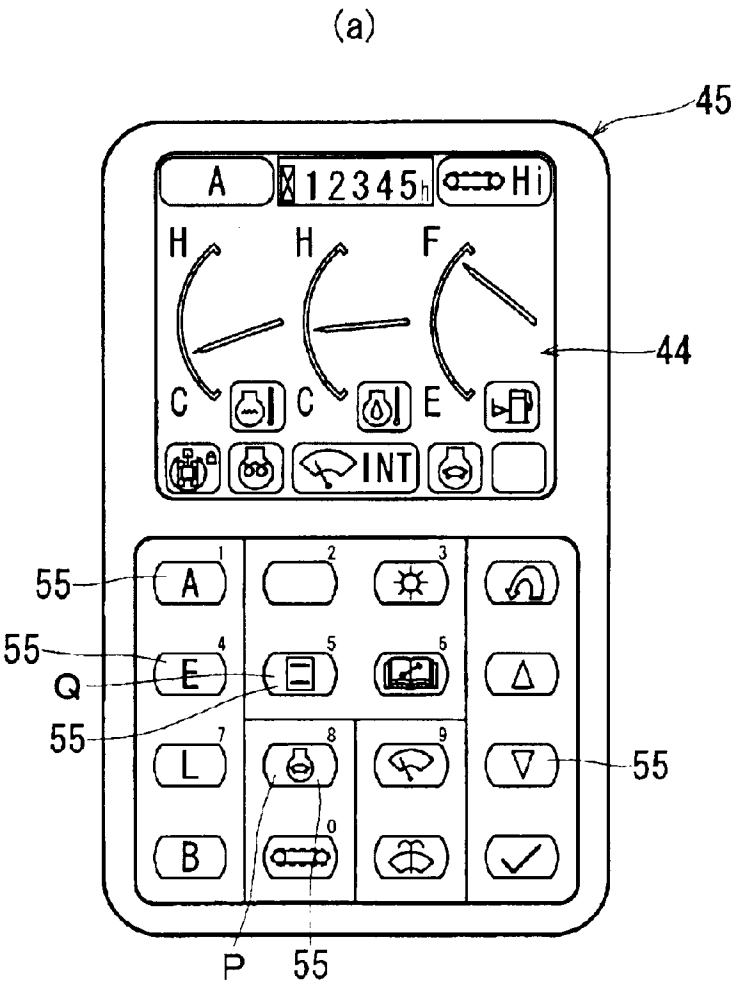
Figure 6:
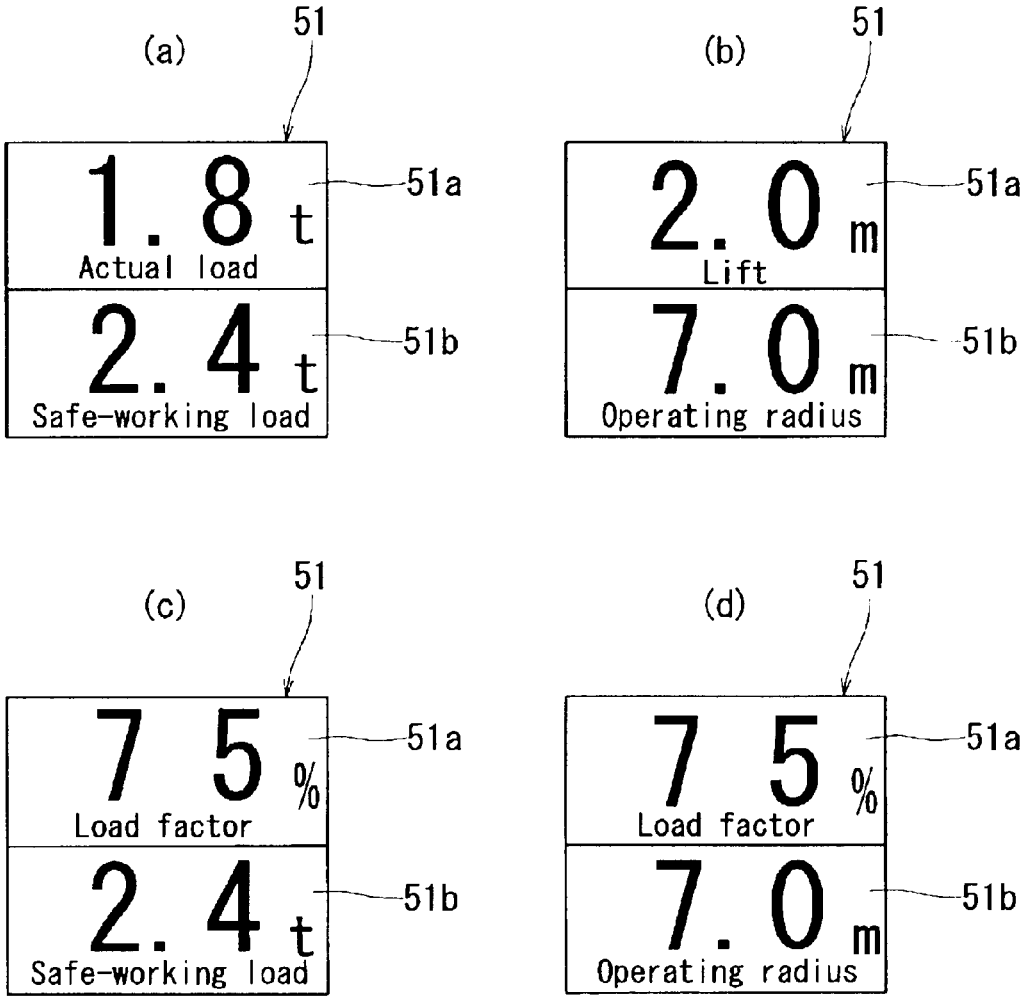
FIG. 6 is a simplified view of a parameter display portion that is displayed on the monitor screen of the above hydraulic shovel concurrently used for crane operations.

It should be noted that the monitor device 45 is provided with a plurality of push buttons 55 . . . as illustrated in FIG. 5, and by pressing, for instance, push button P 55 from among these, it is possible to switch between the first mode and the second mode. Further, by pressing, for instance, push button Q 55, it is possible to switch the display of the parameter display portion 51. More particularly, upon switching to the second mode by pressing the push button P 55, the actual load is displayed in the first portion 51*a* whereas the safe-working load is disposed in the second portion 51*b* as illustrated in FIG. 6A, by pressing the push button Q 55, the lift is displayed in the first portion 51*a* whereas the operating radius is displayed in the second portion 51*b* as illustrated in FIG. 6B, by pushing the push button Q 55 again, the load factor is displayed in the first portion 51*a* whereas the safe-working load is disposed in the second portion 51*b* as illustrated in FIG. 6C, and by repeatedly pushing the push button Q 55, the load factor is displayed in the first portion 51*a* while the operating radius is displayed in the second portion 51*b* as illustrated in FIG. 6D. Combinations of parameters that are to be displayed in the first portion 51*a* and the second portion 51*b* are of course changeable and the order of switching among these is also changeable, and furthermore, the push button 55 affecting the switch is of course not limited to P or Q only.

Figure 9:
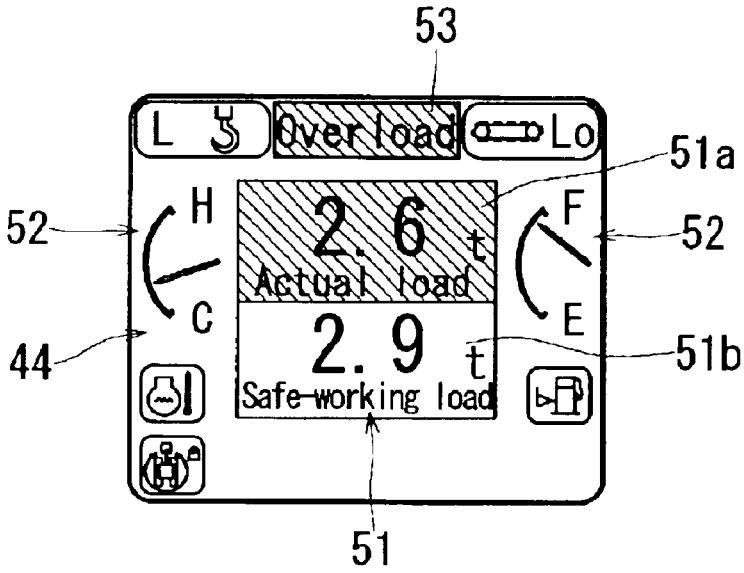
FIG. 9 is a simplified view of the monitor screen with a load factor in an increased condition.
Figure 9:
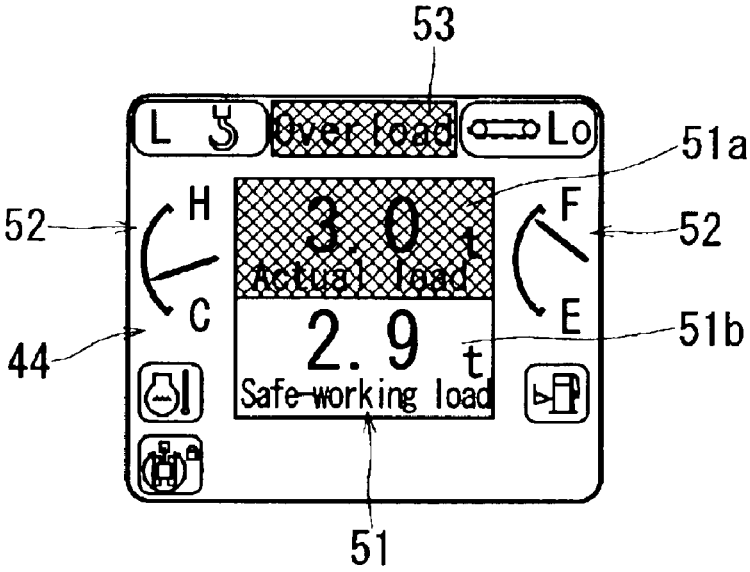

In case the load factor exceeds, for instance, 90% during operation, the first portion 51*a* of the parameter display portion 51 (background portion other than the letters) is changed to an advanced notice color (in the illustrated example, indicated through hatching) as illustrated in FIG. 9A, and in case it exceeds 100%, the first portion 51*a* is changed to an alarm color (in the illustrated example, indicated through meshing) that is different from the advanced notice color as illustrated in FIG. 9B. More particularly, a calculated value as calculated in the calculating means 43 is input to the advance notice/alarm instructing means 46 and an instruction for changing the first portion 41*a* to the advanced notice color is sent to the monitor device 45 in case the value falls within the advanced notice area (area exceeding 90%) whereas an instruction for changing the first portion 51*a* to the alarm color is sent to the monitor device 45 in case the value falls within the dangerous area (area exceeding 100%). For differing the advanced notice color and the alarm color, at least one of its tint, brightness and chromaticity should be differed. More particularly, the entire color of the monitor screen 44 is set to be blue or sky blue in normal conditions, the advanced color to be yellow and the alarm color to be red. When the advanced notice color or the alarm color is dominating, the displayed letters are changed to a color that differs from the advanced notice color or the alarm color or to be written in hollow letters for sharpening the display of the letters. It should be noted that changing the parameter display portion 51 to the advanced notice color or the alarm color also includes cases in which only the displayed letters are changed.

In case the advanced notice color is displayed, an advanced notice sound is generated from the sound generating means 47 and in case the alarm color is displayed, an alarm sound, which is different from the advanced notice color, is generated from the sound generating means 47. More particularly, a signal for generating an advanced notice sound is sent from the advanced notice/alarm instructing means 46 to the sound generating means 47 when in the advanced notice region whereas a signal for generating an alarm sound is sent from the advanced notice/alarm instructing means 46 to the sound generating means 47 when in the alarm region. This sound generating means 47 may, for instance, be consisted by a buzzer, a bell and a speaker or the like. The advanced notice sound and the alarm sound may be differed by employing respectively different sounds, by changing the size of the sound, the height of the sound or the intensity of the sound and the like, and may be further differed to be either a continuous sound or an intermittent sound.

Figure 10:
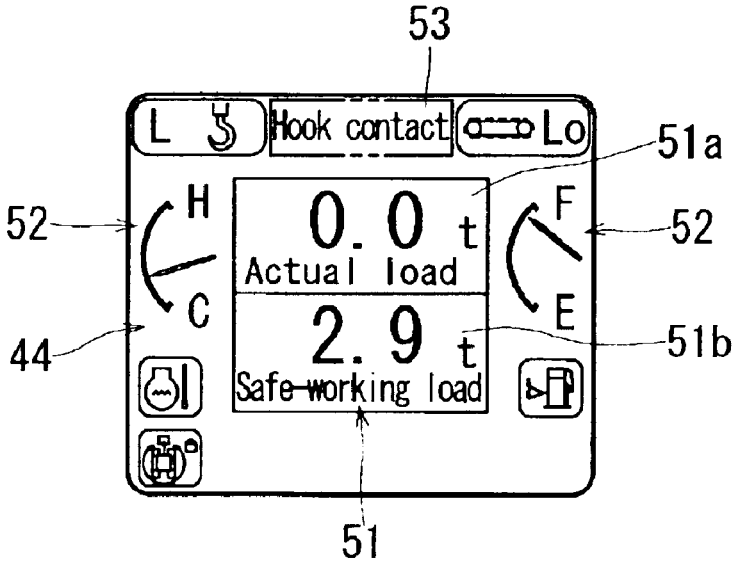
FIG. 10 is a simplified view of the monitor screen in a hook contact alarming condition.
Figure 10:
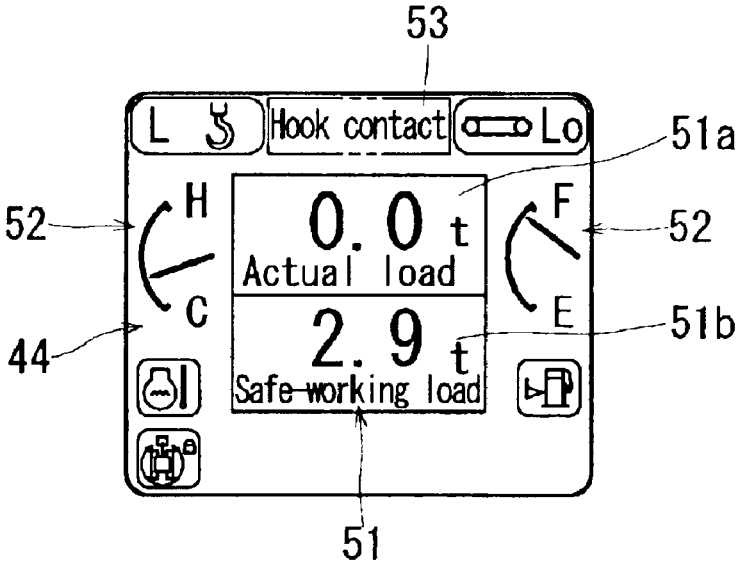
Figure 11:
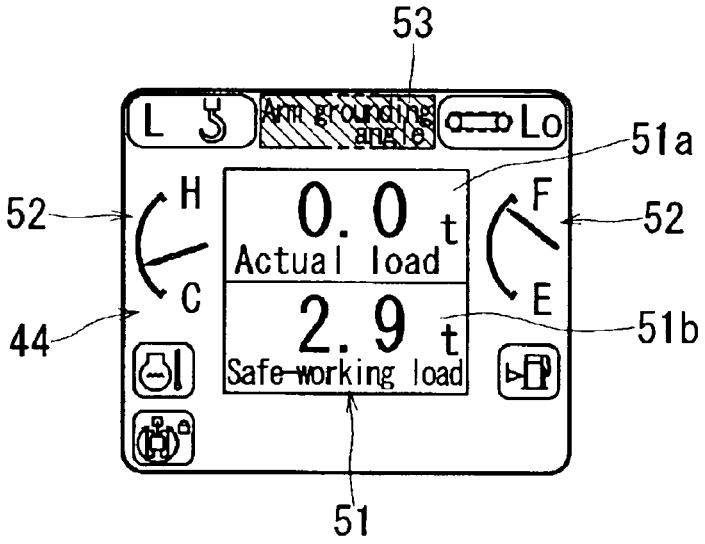
FIG. 11 is a simplified view of the monitor screen in an arm grounding angle alarming condition.
Figure 11:
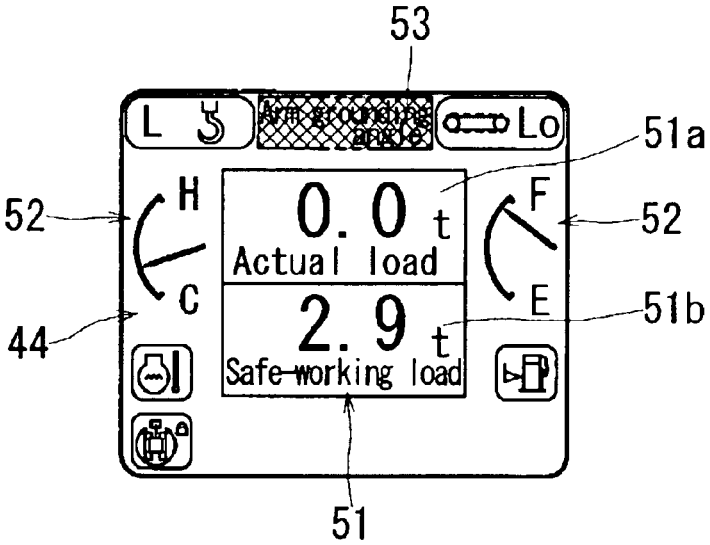

The alarm information display portion 53 displays an advanced notice alert for the arm grounding angle when $165° \leqq \theta < 170°$ is satisfied wherein $\theta$ is a value obtained by adding the boom angle $\alpha$ to the arm angle $\beta$, an alarm alert for the arm grounding angle when $165° > \theta$ is satisfied which is beyond the set operating range, an advanced notice alert for hook contact when $280° < \theta \leqq 285°$ is satisfied, and an alarm alert for hook contact when $285° < \theta$. As illustrated in FIG. 10A, an advance notice alert for hook contact is made by displaying "hook contact" while changing the alarm information display portion 53 to the advanced notice color (in the illustrated example, indicated by the hatching) while an alarm alert for hook contact is made by changing the alarm information display portion 53 to the alarm color (in the illustrated example, indicated by the meshing) while maintaining the display of "hook contact" as illustrated in FIG. 10B. As illustrated in FIG. 11A, an advance notice alert for the arm grounding angle is made by displaying "arm grounding angle" while changing the alarm information display portion 53 to the advanced notice color while an alarm alert for arm grounding angle is made by changing the alarm information display portion 53 to the alarm color while maintaining the display of "arm grounding angle" as illustrated in FIG. 11B.

The advanced notice color and the alarm color of the alarm information display portion 53 are identical to the colors of the advanced notice color and the alarm color of the above parameter display portion 51 and an advanced notice sound is similarly generated when the alarm information display portion 53 turns to the advanced notice color while an alarm sound is generated when the alarm information display portion 53 turns to the alarm color. The alarm information display portion 53 is arranged in that it generally displays load factors (numeric values) unless "hook contact" or "arm grounding angle" fall within the advanced notice area or the dangerous area while the alarm information display portion 53 is changed to the advanced notice color and displays "load factor" when the load factor falls within the above-mentioned advanced notice area as illustrated in FIG. 9A even though the "hook contact" or "arm grounding angle" does not fall within the advanced notice area or the dangerous area, and when the load factor falls within the above-mentioned dangerous area, the alarm information display portion 53 is changed to the alarm color while maintaining the display of "load factor" as illustrated in FIG. 9B. It goes without saying that the advanced notice sound is generated in case the alarm information display portion 53 turns to the advanced notice color and that the alarm sound is generated in case the alarm information display portion 53 turns to the alarm color.

Figure 12:
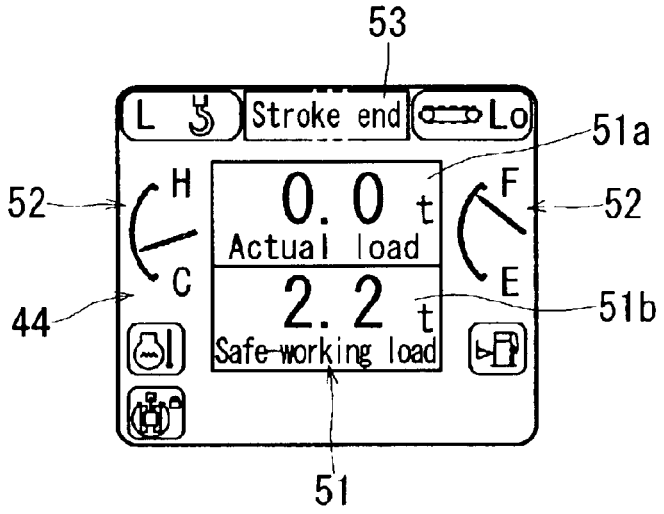
FIG. 12 is a simplified view of the monitor screen in a stroke end alarming condition.
Figure 13:
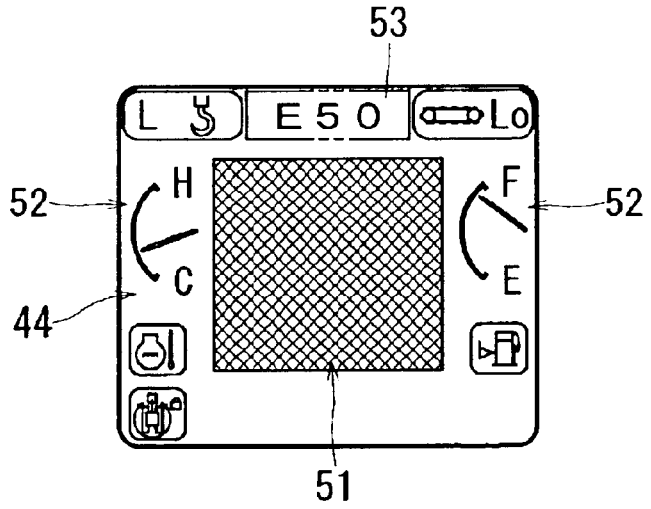
FIG. 13 is a simplified view of the monitor screen in case breakdown has occurred.

It should be noted that the alarm information display portion 53 displays "stroke end" as illustrated in FIG. 12 in addition to the above-mentioned "hook contact" and "arm grounding angle". Here, stroke end denotes a stroke end of the cylinder mechanism 21, wherein "stroke end" is displayed when boom angle $\alpha$>MAX angle −15° is satisfied. In this case, the alarm information display portion 53 is made to be the above advanced notice color. For this reason, the advanced notice sound may be generated together with the advanced notice color. In case of a breakdown of the hydraulic shovel concurrently used for crane operations in which, for instance, no display can be made on the alarm information display portion 53, the entire parameter display portion 51 may be turned to the alarm color as illustrated in FIG. 13. In this case (in cases of other breakdowns), it is possible to perform display in a color that is identical to the above advanced notice color or in a color that differs from both, the advanced notice color and the alarm color. It is further possible to generate a sound that is either identical to or different from the above advanced notice sound or the alarm sound. In a condition (situation) in which the alarm information display portion 53 needs to display a plurality of pieces of information, the respective display items are displayed upon sequentially switching. Also in this case, the respective display items are turned to the advanced notice color when in the advanced notice area and to the dangerous color when in the dangerous region. With this arrangement, the operator may easily keep track of conditions in which various conditions of advanced notice or dangerous conditions occur.

In this manner, according to the hydraulic shovel concurrently used for crane operations of the above arrangement, the letters of "load factor" will be displayed on the alarm information display portion 53 as illustrated in FIG. 9A in case the load factor falls into the advanced notice region even though the parameter display portion 51 is not displaying the load factor while the alarm information display portion 53 and the first portion 51*a* of the parameter display portion 51 turn into the advanced notice color, and when the load factor enters the dangerous area from this condition, the alarm information display portion 53 and the first portion 51*a* of the parameter display portion 51 turn into the alarm color while the letters of "load factor" remain displayed on the alarm information display portion 53 as illustrated in FIG. 9B. The operator may accordingly perceive during operation that the load factor has entered the advanced notice area or the dangerous area, and since advanced notice sounds or alarm sounds are generated, the operator may be ascertained through sight and sound such that he or she may eliminate dangerous conditions upon terminating operations or swinging the implement 4 to be in a safe condition.

When the advanced notice area for hook contact has been entered, the letters of "hook contact" are displayed on the alarm information display portion 53 while the alarm information display portion 53 also changes to the advanced notice color as illustrated in FIG. 10A, and when the hook contact has entered the dangerous area from this condition, the alarm information display portion 53 turns into the alarm color while the letters of "hook contact" remain displayed on the alarm information display portion 53 as illustrated in FIG. 10B. Furthermore, when the advanced notice area for the arm grounding angle has been entered, the letters "arm grounding angle" are displayed on the alarm information display portion 53 and the alarm information display portion 53 further turns into the advanced notice color as illustrated in FIG. 11A, and when the arm grounding angle has entered the dangerous area from this condition, the alarm information display portion 53 turns into the alarm color while the letters of "arm grounding angle" remain displayed on the alarm information display portion 53 as illustrated in FIG. 11B. Consequently, the operator may accordingly perceive that hook contact or the arm grounding angle has entered the advanced notice area or the dangerous area. Since advanced notice sounds or alarm sounds are further generated, the operator may be ascertained of such situations through sight and sound.

According to the above embodiments, since advanced notices and alarms related to "load factor", "hook contact", "arm grounding angle" and "stroke end" are sequentially switched and displayed on the alarm information display portion 53, the operator may reliably keep track of a plurality of advanced notice conditions and alarm conditions. Moreover, since advanced notices and alarms related to "load factor" are individually displayed on the first portion 51*a* of the parameter display portion 51 while displaying such plurality of advanced notices and alarms in a switching manner, advanced notices and alarms related to "load factors", which are of particular importance, may be reliably and rapidly ascertained to thereby improve operability in a more remarkable manner. It should be noted that the present invention also incorporates cases in which no "load factors" are displayed on the alarm information display portion 53.

Since both of parameters related to load factors of safe-working load and engine conditions are simultaneously displayed on the monitor screen 44, the operator of the hydraulic shovel concurrently used for crane operations may easily keep track of various information required during operation so that it is possible to effectively prevent unstable conditions and to perform operations in a safe manner.

The monitor device 45 described above is disposed on a lower portion of a longitudinal frame 58 partitioning a front window 56 of the driver's cab 11 and one of the side windows 57 as illustrated in FIG. 2 and a level 60 is integrally mounted to its package case 59.

While a concrete embodiment of the present invention has been explained so far, the present invention is not limited to the above embodiment but may be implemented upon making various changes that are within the scope of the present invention. For instance, the position of the monitor device 45 is not limited to the position of FIG. 2 unless it is a position at which the operator may observe its monitor screen 44 while driving the hydraulic shovel concurrently used for crane operations while taking seat on the driver's seat 13 or while performing operations using the implement 4. The parameter display portion 51 may also be consisted of a single display portion without providing the first portion 51*a* and the second portion 51*b* in which letters representing the parameters are displayed in a large manner, or on the other hand, be divided into more than three such that a plurality of parameters may be displayed simultaneously. When displaying large letters, display of a single parameter such as the load factor will be easy visible while in case of displaying a plurality of parameters, the plurality of data may be confirmed at a glance. Instead of the first portion 51*a*, it may be the second portion 51*b* that is to be turned into the advanced notice colors or alarm colors. A location for disposing the alarm information display portion 53 may alternatively be a downward position of the parameter display portion 51 or a position between the first portion 51*a* and the second portion 51*b* of the parameter display portion 51. Advanced notice areas and dangerous areas for the "load factor", "hook contact" and "arm grounding angle" may of course be changed as well. It should be noted that the arrangement of the parameter display portion 51 and the alarm information display portion 53 may be such that they do not turn into the advanced notice color also upon entering the advanced notice area or in which no advanced notice sounds or alarm sounds are generated upon turning into the advanced notice colors or the alarm colors. The locations for disposing the parameter display portion 51 and the engine condition display portion 52 may also be varied in which the engine condition display portion 52 is provided in the central portion of the monitor screen 44 with the parameter display portion 51 being disposed around the same.

What is claimed is:

1. A hydraulic shovel concurrently used for crane operations comprising:

an implement including a boom, an arm, a bucket and a hook for enabling crane operations, a monitor device including a monitor screen, wherein it is possible to display parameters related to load factors of safe-working load and alarm information on the monitor screen during said crane operations wherein it is further possible to perform sequentially switched display of a plurality of display items of an alarm information display portion, wherein a parameter display portion is turned into an alarm color in case said load factor of a safe-working load is within a dangerous area, and wherein said alarm information includes arm grounding angle alarm in which an angle formed between the arm of the implement and a ground surface becomes a specified angle and hook contact alarm in which the hook and bucket of the implement come into contact.

2. The hydraulic shovel concurrently used for crane operations as claimed in claim 1, wherein said parameter display portion is disposed in a center of said monitor screen whereas the alarm information display portion is disposed around the parameter display portion to be smaller than the parameter display portion.

3. The hydraulic shovel concurrently used for crane operations as claimed in claim 1, wherein an alarm sound is generated in case at least one of said parameter display portion and the alarm information display portion is in the alarm color.

4. The hydraulic shovel concurrently used for crane operations as claimed in claim 1, wherein at least one of the parameter display portion and the alarm information display portion is turned into an advanced notice color when in an advanced notice area that is close to the dangerous area and into said alarm color when in said dangerous area.

5. The hydraulic shovel concurrently used for crane operations as claimed in claim 4, where in at least one of the parameter display portion and the alarm information display portion generates an advanced notice sound when in the advanced notice color and said alarm sound that is different from said advanced notice sound when in the alarm color.

6. The hydraulic shovel concurrently used for crane operations as claimed in claim 1, wherein an engine condition is displayed on said monitor screen.

7. The hydraulic shovel concurrently used for crane operations as claimed in claim 6, wherein said parameter display portion is disposed in a central portion of the monitor screen whereas an engine condition display portion for displaying said engine condition is disposed around this parameter display portion.

8. The hydraulic shovel concurrently used for crane operations as claimed in claim 1, wherein parameters that are displayed on the parameter display portion are related to actual load, safe-working load, operating radius, operating height and load factor of a safe-working load and others, and wherein multiple switched display among these is possible.

* * * * *